US009671707B2

(12) United States Patent
Minagawa et al.

(10) Patent No.: US 9,671,707 B2
(45) Date of Patent: Jun. 6, 2017

(54) APPARATUS FOR HEAT-TREATING POWDER PARTICLES AND METHOD OF PRODUCING TONER

(75) Inventors: Hironori Minagawa, Moriya (JP); Yuichi Mizo, Toride (JP); Takeshi Ohtsu, Toride (JP); Takakuni Kobori, Toride (JP); Kohji Takenaka, Toride (JP); Junichi Hagiwara, Tsuchiura (JP); Daisuke Ito, Tsuchiura (JP); Kunihiko Kawakita, Iga (JP); Yasumori Kanai, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 679 days.

(21) Appl. No.: 14/125,573

(22) PCT Filed: Jun. 7, 2012

(86) PCT No.: PCT/JP2012/065178

§ 371 (c)(1),
(2), (4) Date: Dec. 11, 2013

(87) PCT Pub. No.: WO2012/173165

PCT Pub. Date: Dec. 20, 2012

(65) Prior Publication Data

US 2014/0101966 A1 Apr. 17, 2014

(30) Foreign Application Priority Data

Jun. 13, 2011 (JP) ..... 2011-130923

(51) Int. Cl.
*G03G 9/00* (2006.01)
*G03G 9/08* (2006.01)
*F26B 17/10* (2006.01)

(52) U.S. Cl.
CPC ..... *G03G 9/0812* (2013.01); *F26B 17/103* (2013.01); *G03G 9/081* (2013.01);
(Continued)

(58) Field of Classification Search
CPC .... G03G 9/0808; G03G 9/0815; F26B 17/103
(Continued)

(56) References Cited

U.S. PATENT DOCUMENTS 4,736,527 A 4/1988 Iwamoto et al.
7,273,686 B2 9/2007 Onuma et al.
(Continued)

FOREIGN PATENT DOCUMENTS

CN 101093368 A 12/2007
JP 59-127662 A 7/1984
(Continued)

OTHER PUBLICATIONS

Chinese Office Action dated Nov. 4, 2015 in Chinese Application No. 201280029261.5.
(Continued)

*Primary Examiner* — Mark A Chapman
(74) *Attorney, Agent, or Firm* — Fitzpatrick Cella Harper and Scinto

(57) ABSTRACT

Provided is an apparatus for heat treatment capable of heat-treating toner particles efficiently and uniformly while suppressing increase of coarse particles due to coalescence, to thereby enable stable toner production. The apparatus for heat-treating powder particles each of which contains a binder resin and a colorant includes: a cylindrical treatment chamber in which the powder particles are heat-treated; a columnar member (6) provided so as to protrude from a lower end part of the treatment chamber toward an upper end part thereof; a powder particle supply unit (2) for supplying the powder particles to the treatment chamber; a hot air supply unit (3) for heat-treating the supplied powder particles; and a collection unit (5) for collecting the heat-treated powder particles discharged outside the treatment chamber through a toner discharge port provided on the lower end
(Continued)

part side of the treatment chamber. The hot air supply unit is provided so that the hot air is supplied along an inner circumferential surface of the treatment chamber. The powder particle supply unit includes multiple particle supply ports provided on an outer circumferential surface of the columnar member. The toner discharge port is provided in an outer circumferential portion of the treatment chamber so as to keep a rotation direction of the powder particles.

6 Claims, 8 Drawing Sheets

(52) U.S. Cl.
CPC ..... *G03G 9/0804* (2013.01); *G03G 9/0806* (2013.01); *G03G 9/0808* (2013.01); *G03G 9/0815* (2013.01)

(58) Field of Classification Search
USPC ..... 430/137.1, 137.2, 137.18
See application file for complete search history.

(56) References Cited

U.S. PATENT DOCUMENTS

| | | | | |
|---|---|---|---|---|
| 8,455,167 | B2 | 6/2013 | Shiotari et al. | |
| 9,075,328 | B2 * | 7/2015 | Minagawa | G03G 9/0804 |
| 9,372,960 | B2 * | 6/2016 | Shie | G06Q 50/24 |
| 2013/0323638 | A1 | 12/2013 | Minagawa et al. | |
| 2014/0096409 | A1 | 4/2014 | Ohtsu et al. | |
| 2014/0120468 | A1 | 5/2014 | Mizo et al. | |
| 2014/0137428 | A1 | 5/2014 | Takenaka et al. | |

FOREIGN PATENT DOCUMENTS

| | | | |
|---|---|---|---|
| JP | 62-132534 | A | 6/1987 |
| JP | 3-52858 | B2 | 8/1991 |
| JP | 4-126534 | A | 4/1992 |
| JP | 2000-29241 | A | 1/2000 |
| JP | 2000-140661 | A | 5/2000 |
| JP | 2004-189845 | A | 7/2004 |
| JP | 2004-276016 | A | 10/2004 |
| JP | 2011-128487 | A | 6/2011 |
| JP | 2011-128488 | A | 6/2011 |
| WO | 2011/074060 | A1 | 6/2011 |

OTHER PUBLICATIONS

PCT International Search Report and Written Opinion of the International Searching Authority, International Application No. PCT/JP2012/065178, Mailing Date Aug. 7, 2012.

* cited by examiner

PRIOR ART

APPARATUS FOR HEAT-TREATING POWDER PARTICLES AND METHOD OF PRODUCING TONER

TECHNICAL FIELD

The present invention relates to an apparatus for heat-treating powder particles, for producing toner to be used in an image forming method such as an electrophotographic method, an electrostatic recording method, an electrostatic printing method, or a toner jet system recording method, and to a method of producing toner using the apparatus.

BACKGROUND ART

In order to produce toner with appropriate circularity, there has been proposed an apparatus for heat-treating powder particles to spheroidize a shape of toner appropriately. However, in a conventional apparatus for heat treatment, the amount of heat which powder particles receive varies depending upon the position through which the powder particles pass, and hence it is difficult to heat-treat powder particles uniformly.

In order to overcome the above-mentioned problem, an apparatus for heat treatment has been proposed, in which a powder particle supply portion is provided at the center of the apparatus, and a hot air supply portion is provided outside of the powder particle supply portion (see Patent Literatures 1 and 3). Further, in order to heat-treat toner particles uniformly, an apparatus for heat-treatment while rotating an air stream inside the apparatus has also been proposed (see Patent Literature 2).

CITATION LIST

Patent Literature

PTL 1: Japanese Patent Application Laid-Open No. 2004-189845

PTL 2: Japanese Examined Patent Publication No. H03-52858

PTL 3: Japanese Patent Application Laid-Open No. 2004-276016

SUMMARY OF INVENTION

Technical Problem

However, in the apparatus for heat treatment described in Patent Literature 1, it is necessary to provide multiple raw material injection nozzles, which enlarges the apparatus. Further, a larger amount of compressed gas is required for supplying powder particles, which is not preferred in terms of production energy. In addition, in this apparatus, a raw material is injected linearly to annular hot air to thus cause a loss in a treatment part, which is inefficient for increasing a treatment amount.

Further, the inventors of the present invention studied the apparatus for heat treatment described in Patent Literature 2, and confirmed that toner was not dispersed sufficiently and coarse particles were increased due to the coalescence of toner. Further, when a treatment amount was increased, a heat treatment efficiency of toner decreased rapidly, and heat-treated toner and untreated toner were mixed. The reason for this is considered as follows: a powder particle input portion is provided inside a compressed air supply portion, and the powder particles are not dispersed so much inside the apparatus, and hence, instantaneous heat treatment is conducted in a narrow range.

Further, in the apparatus for heat treatment described in Patent Literature 3, when a member inside the apparatus receives heat and stores heat, toner is fused to the member storing heat to thus prevent stable production of toner, which is not preferred in terms of toner productivity.

It is an object of the present invention to provide an apparatus for heat-treating powder particles, for producing toner particles containing fewer coarse particles or less toner fine powder and having a sharp particle size distribution, and a method of producing toner using the above-mentioned apparatus. It is another object of the present invention to provide an apparatus for heat-treating powder particles, for producing toner particles having a circularity distribution within an appropriate range and having a sharp circularity distribution, and a method of producing toner using the above-mentioned apparatus.

Solution to Problem

The present invention is directed to an apparatus for heat-treating powder particles each of which contains a binder resin and a colorant, the apparatus for heat treatment including:

(1) a treatment chamber having a cylindrical shape, in which the powder particles are heat-treated;

(2) a columnar member having a substantially circular shape in cross-section, the columnar member being provided on a center axis of the treatment chamber so as to protrude from a lower end part of the treatment chamber toward an upper end part of the treatment chamber;

(3) a powder particle supply unit for supplying the powder particles to the treatment chamber;

(4) a hot air supply unit for supplying hot air for heat-treating the supplied powder particles; and (5) a collection unit for collecting the heat-treated powder particles discharged outside the treatment chamber through a toner discharge port provided on the lower end part side of the treatment chamber.

The hot air supply unit is provided so that the hot air is supplied while being rotated along an inner circumferential surface of the treatment chamber.

The powder particle supply unit includes multiple particle supply ports provided on an outer circumferential surface of the columnar member.

The toner discharge port is provided in an outer circumferential portion of the treatment chamber so as to keep a rotation direction of the powder particles.

Further, the present invention is directed to a method of producing toner using the above-mentioned heat treatment apparatus.

Advantageous Effects of Invention

According to the present invention, it is possible to obtain the toner particles containing fewer coarse particles or less toner fine powder and having a sharp particle size distribution. Further, it is possible to obtain the toner particles having a circularity distribution within an appropriate range and having a sharp circularity distribution.

Further features of the present invention will become apparent from the following description of exemplary embodiments with reference to the attached drawings.

DESCRIPTION OF EMBODIMENTS

In order to ensure a satisfactory transfer property of toner, it is preferred that an average circularity of toner be 0.960 or more, more preferably 0.965 or more.

Further, in consideration of an image forming apparatus that removes residual toner from a photosensitive member through use of a cleaning member such as a blade, it is preferred that a content of particles each having a circularity of 0.990 or more in toner be 35% or less, more preferably 30% or less.

Figure 1:
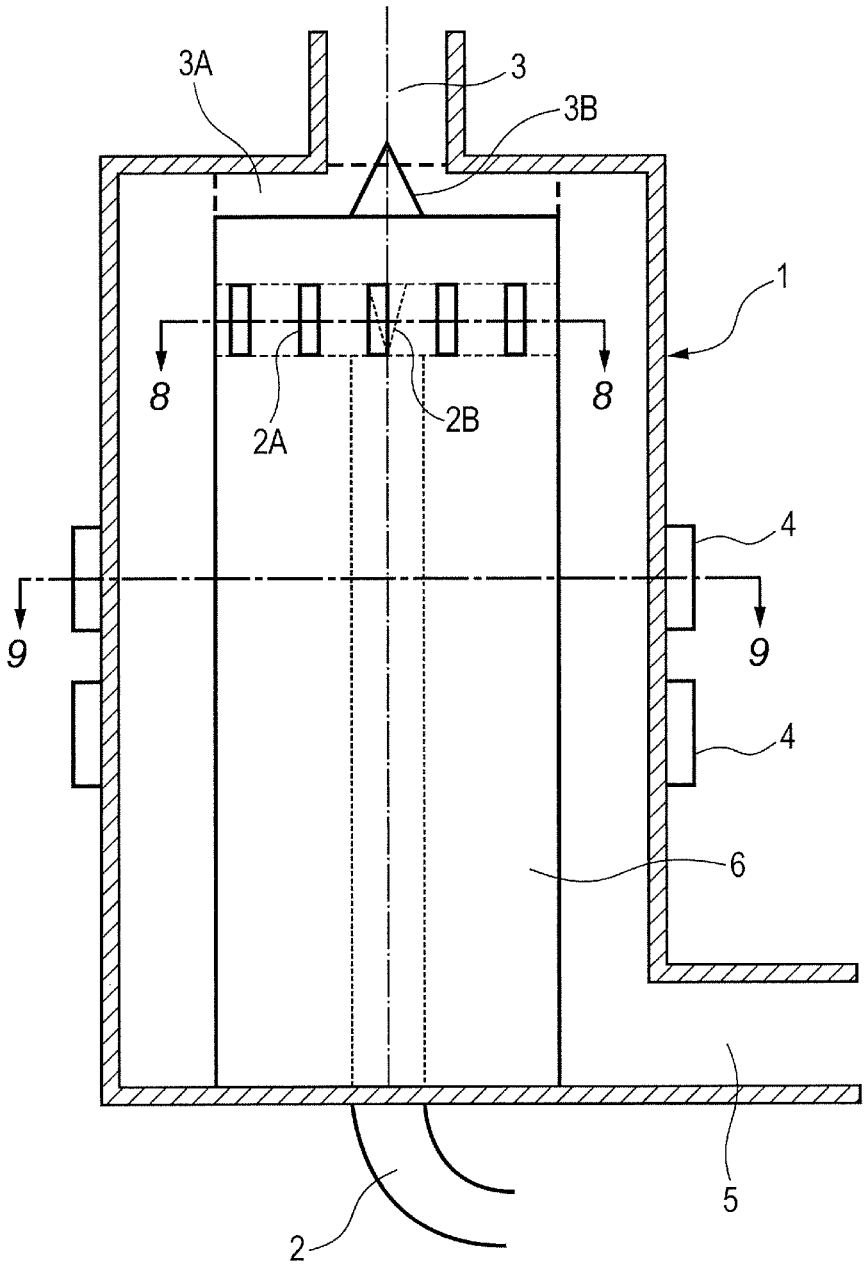
FIG. 1 is a cross-sectional view illustrating a structure of Example 1.

Hereinafter, an apparatus for heat treatment of the present invention is described with reference to the drawings. FIG. 1 illustrates an example of an apparatus for heat-treating powder particles of the present invention.

Figure 5:
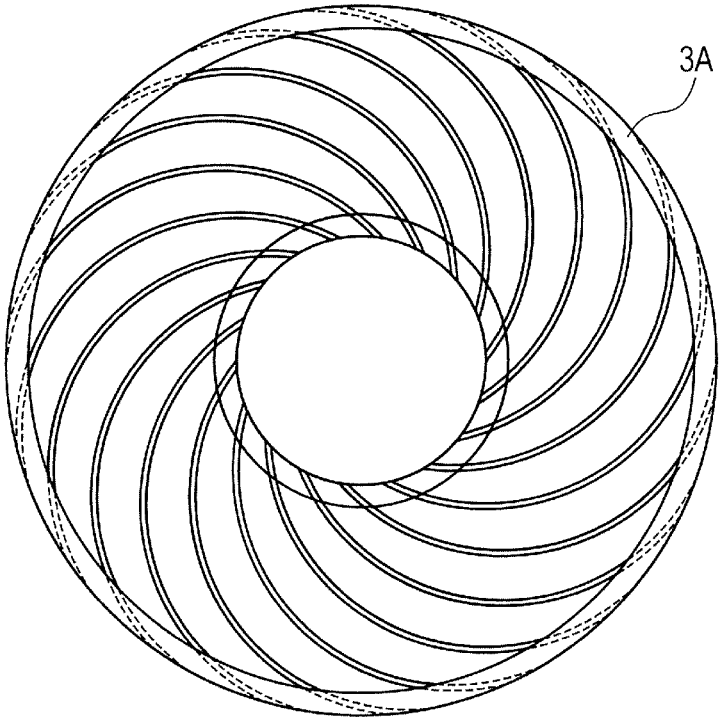
FIG. 5 is a view illustrating an example of a regulating member for hot air.

An apparatus for heat treatment (1) of the present invention includes a treatment chamber having a cylindrical shape. A hot air supply unit (3) is provided in an upper part of the apparatus for heat treatment (1), and a columnar member (hereinafter, referred to as "center pole") (6) having a substantially circular shape in cross-section is provided on a center axis inside the apparatus main body (1) so as to protrude from a lower end part of the treatment chamber toward an upper end part thereof. On an upper surface of the center pole (6), a regulating member (3A) and a conical member (3B) for rotating hot air are provided. It is preferred to use, as the regulating member (3A) for hot air, a louver-type regulating member as illustrated in FIG. 5 so that hot air is supplied along an inner circumferential surface of the treatment chamber, but the present invention is not limited thereto. The center pole (6) further includes, in the axial center part, a passage for supplying powder particles from a powder particle supply unit (2). The powder particles are conveyed through the passage inside the center pole (6) by compressed gas. Further, a conical member (2B) is provided at the center of the upper end part of the passage. The center pole (6) also includes, on an outer circumferential surface thereof below an outlet portion of the hot air supply unit (3), multiple outlet portions (2A) for supplying the powder particles into the apparatus. Further, the passage inside the center pole (6) is connected to particle supply ports of the outlet portions (2A) through passages extending radially. The conical member (2B) having a substantially conical shape is provided at a branch point of the passage inside the center pole (6), and thus, the powder particles are distributed to the respective particle supply ports of the outlet portions (2A) in a substantially uniform state. It is preferred that the passage inside the center pole (6) be configured so that the powder particles are ejected from the outlet portions (2A) in the direction same as the rotation direction of hot air. In the apparatus for heat treatment of the present invention, the powder particles are supplied from the outlet portions (2A) of the center pole (6) to the treatment chamber, as described above. Further, hot air is supplied from the hot air supply unit so as to be rotated along the inner circumferential surface of the treatment chamber. With this structure, the supply direction of the powder particles is a direction from the apparatus center part toward the outside, and hence, the powder particles can reach the inner circumferential surface of the treatment chamber more easily. Moreover, the powder particles can be efficiently sent to the inner circumferential surface of the treatment chamber, at which the heat treatment effect of hot air is largest, and hence, the powder particles can be heat-treated sufficiently and substantially uniformly.

At least one, preferably multiple, cold air supply unit (4) is provided below the outlet portions (2A) for the powder particles. It is preferred that the cold air supply unit (4) be provided so as to supply cold air in such a manner as to keep the flow of rotation of the hot air and the powder particles in the apparatus. Further, a toner discharge port is provided on a lower end part side of the apparatus for heat treatment (1). The toner discharge portion is provided in a tangent direction so as to keep the rotation of the powder particles and the like in the apparatus as well.

It is preferred that a flow velocity VQ at the outlet portion of the hot air supply unit (3) and a flow velocity VT at the outlet portion of the powder particle supply unit (2) be adjusted to have a relationship of VQ>VT. When VQ>VT is satisfied, the powder particles can be carried in a rectified state without causing a turbulent flow with respect to the rotation of hot air, and hence, the powder particles can be treated uniformly.

In order to prevent an increase in temperature of the apparatus for heat treatment, it is preferred that the treatment chamber and the center pole (6) be cooled and jacketed.

It is preferred that the temperature C (° C.) of the hot air to be supplied inside the apparatus in the outlet portion of the hot air supply unit (3) be $100 \leq C \leq 450$. When the temperature of the hot air in the outlet portion of the hot air supply unit (3) is within the above-mentioned range, the powder particles can be spheroidized uniformly while the fusion and coalescence of the powder particles caused by excessive heating are suppressed.

The heat-treated powder particles are cooled by the cold air supply unit (4) provided on an upstream side relative to the toner discharge port. At this time, in order to manage the temperature inside the apparatus and control the surface state of toner, cold air may be introduced from the cold air supply unit (4) provided on the side surface of the apparatus main body. The outlet portion of the cold air supply unit (4) may have a slit shape, a louver shape, a porous plate shape, a mesh shape, or the like, and the introduction direction is a direction along the wall surface of the apparatus.

It is preferred that the temperature E (° C.) inside the cold air supply unit (4) be $-20 \leq E \leq 40$. When the temperature inside the cold air supply unit (4) is within the above-mentioned range, the heat-treated powder particles can be cooled appropriately, and the fusion and coalescence of the powder particles can be suppressed without hindering the powder particles from being spheroidized uniformly.

The cooled powder particles are discharged outside the treatment chamber through the toner discharge port and collected by a collection unit (5). A blower (not shown) is provided on a downstream side of the collection unit (5), and the powder particles are sucked and conveyed by the blower. The collection unit (5) may be provided in a multiple number as long as the flow of the rotation of the powder particles and the like inside the apparatus can be kept.

It is preferred that a total amount QIN of the flow rate of compressed gas, hot air, and cold air supplied to the apparatus for heat treatment and an air volume QOUT sucked by the blower be adjusted to have a relationship of QIN≤QOUT. When QIN≤QOUT is satisfied, the pressure inside the apparatus becomes a negative pressure, and hence, the jetted powder particles are discharged easily outside the apparatus, which can prevent the powder particles from receiving excessive heat. Consequently, an increase of coalesced powder particles and the fusion of the powder particles inside the apparatus can be suppressed.

The process of spheroidizing powder particles through use of the above-mentioned apparatus for heat treatment is described.

The hot air supplied from the hot air supply unit moves downward while rotating in a spiral shape along the inner wall surface inside the apparatus. At this time, a temperature gradient is caused by a centrifugal force, in which the temperature on the outer circumferential side of the apparatus is high and the temperature becomes lower toward the inner side. On the other hand, the powder particles supplied from the powder particle supply unit are supplied from an upstream side or a downstream side of the hot air so as to rotate inside the apparatus in the same direction as that of the hot air. Adjustment is made so as to satisfy the relationship of VQ>VT, and hence, the powder particles can be carried in the flow of the hot air without causing a turbulent flow in the flow of the rotation of the hot air. Further, a shear effect is exerted due to a difference in a flow velocity between VQ and VT, and the powder particles are dispersed in a heat treatment space inside the treatment chamber, which can suppress coalesced particles. Further, the powder particles rotate inside the apparatus, and hence, particles each having a large particle diameter pass through a passage with a large rotation radius and particles each having a small particle diameter pass through a passage with a small rotation radius due to the centrifugal force. Consequently, the particles each having a large particle diameter receive heat for a long period of time, whereas the particles each having a small particle diameter receive heat for a short period of time. Therefore, it is possible to heat-treat the powder particles in an amount of heat in accordance with the size of the particle diameter.

It should be noted that the present invention is not limited to the mode illustrated in the figures.

Figure 6:
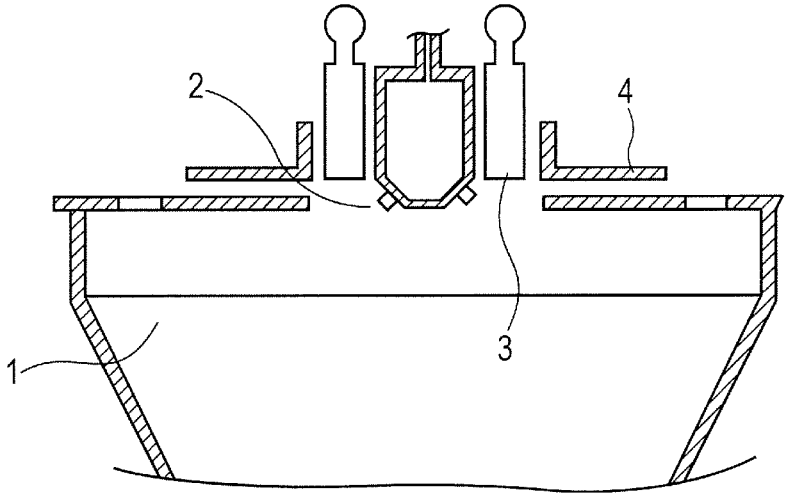
FIG. 6 is a view illustrating a structure of Comparative Example 1.
Figure 7:
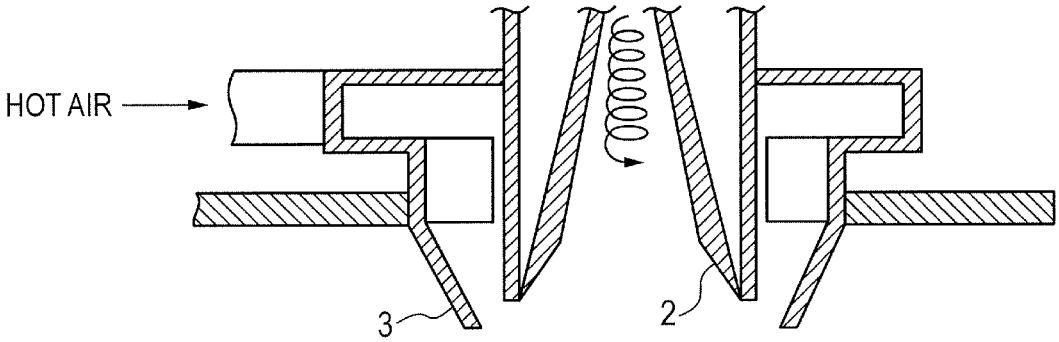
FIG. 7 is a view illustrating a structure of Comparative Example 2.
Figure 8:
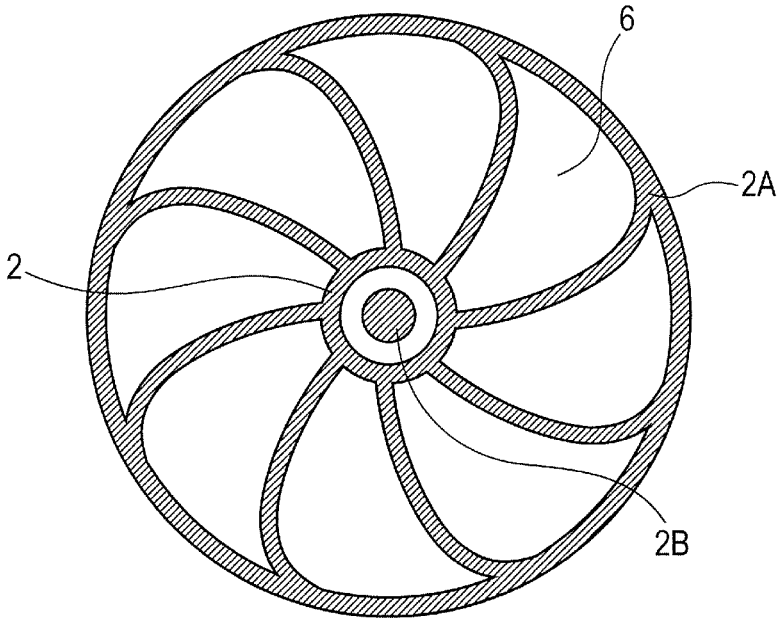
PRIOR ART FIG. 8
FIG. 8 is a cross-sectional view taken along the line 8-8 in FIG. 1.

FIGS. 6 and 7 illustrate apparatus for heat treatment used conventionally. The apparatus illustrated in FIG. 6 has a structure in which a jet port for jetting powder particles into the apparatus is provided in hot air, and the powder particles are dispersed in the hot air by compressed air. However, with this structure, the powder particles are not dispersed sufficiently, and it is impossible to apply an amount of heat in accordance with the particle diameter of the particles unlike the apparatus for heat treatment of the present invention. Further, there is a variation in the amount of heat to be applied to the powder particles irrespective of the particle diameter of the particles, and a mixing ratio of particles that are not heat-treated sufficiently becomes high. When the amount of heat to be applied is increased so as to lower a mixing ratio of untreated particles, an average circularity increases, but the proportion of particles each having a circularity of 0.990 or more increases and the coalescence of the powder particles may occur.

Further, in the apparatus illustrated in FIG. 7, the powder particles are jetted while being rotated. However, a suction portion in a lower part of the apparatus is provided at the center of the apparatus, and hence, the powder particles do not spread in a horizontal direction sufficiently when the powder particles rotate. Therefore, the powder particles are dispersed insufficiently, and hence the powder particles are heat-treated in a non-uniform manner, and coalesced particles are liable to increase. Consequently, in the heat-treated powder particles, the proportion of the coarse particles and the proportion of the particles each having a circularity of 0.990 or more increase.

The powder particles to be used in the present invention contain a binder resin and a colorant. Examples of the binder resin include a vinyl-based resin, a polyester-based resin, and an epoxy resin. Of those, a vinyl-based resin and a polyester-based resin are more preferred in terms of chargeability and fixability. In particular, in the case of using the polyester-based resin as the binder resin for the powder particles, an effect obtained through use of the apparatus for heat treatment of the present invention is large.

The binder resin may be mixed with a homopolymer or a copolymer of a vinyl-based monomer, polyester, polyurethane, an epoxy resin, polyvinyl butyral, rosin, modified rosin, a terpene resin, a phenol resin, an aliphatic or alicyclic hydrocarbon resin, an aromatic petroleum resin, or the like before use, if required.

In the case where at least two kinds of resins are mixed to be used as the binder resin, it is more preferred that resins having different molecular weights be mixed in an appropriate mixing ratio.

The glass transition temperature of the binder resin is preferably 45 to 80° C., more preferably 55 to 70° C., the number average molecular weight (Mn) thereof is preferably 2,500 to 50,000, and the weight average molecular weight (Mw) thereof is preferably 10,000 to 1,000,000.

It is preferred that the polyester resin contain 45 to 55 mol % of an alcohol component and 55 to 45 mol % of an acid component among all the components.

The acid number of the polyester resin is preferably 90 mgKOH/g or less, more preferably 50 mgKOH/g or less, and the hydroxyl number thereof is preferably 50 mgKOH/g or less, more preferably 30 mgKOH/g or less.

The glass transition temperature of the polyester resin is preferably 50 to 75° C., more preferably 55 to 65° C., the number-average molecular weight (Mn) thereof is preferably 1,500 to 50,000, more preferably 2,000 to 20,000, and the weight average molecular weight (Mw) thereof is preferably 6,000 to 100,000, more preferably 10,000 to 90,000.

When the toner is used as magnetic toner, as a magnetic material contained in the magnetic toner, there are given, for example: iron oxides such as magnetite, maghemite, and ferrite, and other iron oxides containing metal oxides; metals such as Fe, Co, and Ni, or alloys of the metals with metals such as Al, Co, Cu, Pb, Mg, Ni, Sn, Zn, Sb, Be, Bi, Cd, Ca, Mn, Se, Ti, W, and V; and mixtures thereof.

Specific examples of the magnetic material include triiron tetraoxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), and nickel powder (Ni). The magnetic material may be used alone or in combination of two or more kinds thereof. The magnetic material is particularly suitably triiron tetraoxide or γ-iron sesquioxide fine powder.

It is recommended to use 20 to 150 parts by mass, preferably 50 to 130 parts by mass, more preferably 60 to 120 parts by mass of the magnetic material with respect to 100 parts by mass of the binder resin.

A non-magnetic colorant includes the following.

A black colorant includes the following: carbon black; and a black colorant prepared by using a yellow colorant, a magenta colorant, and a cyan colorant.

A coloring pigment for magenta toner includes the following: a condensed azo compound, a diketopyrrolopyrrole compound, anthraquinone, a quinacridone compound, a basic dye lake compound, a naphthol compound, a benzimidazolone compound, a thioindigo compound, and a perylene compound. Specific examples thereof include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 254, or 269; C.I. Pigment Violet 19; and C.I. Vat Red 1, 2, 10, 13, 15, 23, 29, or 35.

In the colorant, a pigment may be used alone. However, it is preferred that a dye and a pigment are used in combination to improve the color definition of the colorant from the viewpoint of increasing the image quality of a full color image.

A dye for magenta toner includes the following: oil-soluble dyes such as C.I. Solvent Red 1, 3, 8, 23, 24, 25, 27, 30, 49, 81, 82, 83, 84, 100, 109, or 121, C.I. Disperse Red 9, C.I. Solvent Violet 8, 13, 14, 21, or 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, or 40, and C.I. Basic Violet 1, 3, 7, 10, 14, 15, 21, 25, 26, 27, or 28.

A coloring pigment for cyan toner includes the following: C.I. Pigment Blue 1, 2, 3, 7, 15:2, 15:3, 15:4, 16, 17, 60, 62, or 66; C.I. Vat Blue 6; C.I. Acid Blue 45; and a copper phthalocyanine pigment having a phthalocyanine skeleton with 1 to 5 phthalimidomethyl substituents.

A coloring pigment for yellow toner includes the following: a condensed azo compound, an isoindolinone compound, an anthraquinone compound, an azo metallic compound, a methine compound, and an arylamide compound. Specific examples thereof include: C.I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, or 191; and C.I. Vat Yellow 1, 3, or 20. Further, dyes such as C.I. Direct Green 6, C.I. Basic Green 4, C.I. Basic Green 6, and C.I. Solvent Yellow 162 may be used.

Further, in the case of producing the above-mentioned toner (powder particles) by a pulverization method, it is preferred to use a master batch formed by mixing a colorant with a binder resin in advance. Then, the colorant master batch and other raw materials (such as a binder resin and a wax) can be melt-kneaded to disperse the colorant in toner satisfactorily.

In the case of mixing a colorant with a binder resin to form a master batch, the dispersibility of the colorant is not degraded even when the colorant is used in a large amount, and the dispersibility of the colorant in toner particles is improved. Consequently, color reproducibility such as color mixture property and transparency becomes excellent. Further, toner having a large covering power on a transfer member can be obtained. Further, owing to the improvement of the dispersibility of the colorant, endurance stability of toner becomes excellent, and an image keeping high image quality can be obtained.

The colorant is used in an amount of preferably 0.1 to 30 parts by mass, more preferably 0.5 to 20 parts by mass, particularly preferably 3 to 15 parts by mass with respect to 100 parts by mass of the binder resin.

A charge control agent can be used in toner, if required, so as to additionally stabilize the chargeability. It is preferred that the charge control agent be used in an amount of 0.5 to 10 parts by mass with respect to 100 parts by mass of the binder resin.

The charge control agent includes the following.

As a negative charge control agent for controlling toner to be negatively charged, for example, an organometallic complex or a chelate compound is effective, and examples thereof include a monoazo metal complex, an aromatic hydroxycarboxylic acid metal complex, and an aromatic dicarboxylic acid-based metal complex. Further examples thereof include an aromatic hydroxycarboxylic acid, aromatic mono- and polycarboxylic acids and metal salts thereof, anhydrides thereof, or esters thereof, and a phenol derivative of bisphenol.

As a positive charge control agent for controlling toner to be positively charged, there are given, for example: nigrosine and denatured products of nigrosine with fatty acid metal salts and the like, quaternary ammonium salts such as tributylbenzylammonium-1-hydroxy-4-naphthosulfonate and tetrabutylammonium tetrafluoroborate, onium salts such as phosphonium salts as analogs of the quaternary ammonium salts, triphenylmethane dyes as chelate pigments of the salts, lake pigments thereof (lake agents including phosphotungstenic acid, phosphomolybdic acid, phosphotungsten molybdic acid, tannic acid, lauric acid, gallic acid, ferricyanic acid, and a ferrocyanide compound), metal salts of higher fatty acids, diorganotin oxides such as dibutyltin oxide, dioctyltin oxide, and dicyclohexyltin oxide, and diorganotin borates such as dibutyltin borate, dioctyltin borate, and dicyclohexyltin borate.

It is preferred that the powder particles contain one kind or two or more kinds of release agents as needed. Examples of the release agents include the following.

There are given, for example: aliphatic hydrocarbon-based waxes such as low-molecular weight polyethylene, low-molecular weight polypropylene, a microcrystalline wax, and a paraffin wax; oxides of aliphatic hydrocarbon-based waxes such as a polyethylene oxide wax or block copolymers thereof; waxes mainly including fatty acid esters such as a carnauba wax, a sasol wax, and a montanic acid ester wax; and partially or wholly deacidified fatty acid esters such as a deacidified carnauba wax. There are also given, for example: saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; long-chain alkylalcohols; polyhydric alcohols such as sorbitol; fatty acid amides such as linoleic acid amide, oleic acid amide, and lauric acid amide; saturated fatty acid bisamides such as methylenebis (stearic acid amide), ethylenebis(capric acid amide) ethylenebis(lauric acid amide), and hexamethylenebis(stearic acid amide); unsaturated fatty acid amides such as ethylenebis(oleic acid amide), hexamethylenebis(oleic acid amide), N,N'-dioleyl adipic acid amide, and N,N'-dioleyl sebacic acid amide; aromatic bisamides such as m-xylene stearic acid amide and N'N-distearyl isophthalic acid amide; fatty acid metal salts (generally referred to as metallic soaps) such as calcium stearate, calcium laurate, zinc stearate, and magnesium stearate; waxes obtained by grafting aliphatic hydrocarbon-based waxes with vinyl-based monomers such as styrene and acrylic acid; partially esterified compounds of fatty acids and polyhydric alcohols such as behenic monoglyceride; and methyl ester compounds each having a hydroxyl group obtained by the hydrogenation of vegetable fats and oils.

The amount of the release agent to be used is preferably 0.1 to 20 parts by mass, more preferably 0.5 to 10 parts by mass with respect to 100 parts by mass of the binder resin.

Further, the melting point of the release agent defined by a maximum endothermic peak temperature at the time of temperature rise measured with a differential scanning calorimeter (DSC) is preferably 65 to 130° C., more preferably 80 to 125° C.

In the present invention, a flowability-imparting agent may be externally added to powder particles before heat treatment or powder particles after heat treatment. Examples of the flowability-imparting agent include: fluorine-based resin powder such as vinylidene fluoride fine powder and polytetrafluoroethylene fine powder; and silica fine powder such as wet silica and dry silica, titanium oxide fine powder, and alumina fine powder subjected to a surface treatment and a hydrophobizing treatment with a silane coupling agent, a titanium coupling agent, or silicone oil.

As the titanium oxide fine powder, there are used titanium oxide fine particles obtained by a sulfuric acid method, a chlorine method, and low-temperature oxidation (thermolysis, hydrolysis) of volatile titanium compounds such as a titanium alkoxide, a titanium halide, and titanium acetylacetonate. As a crystal system, there may be used any of an anatase type crystal, a rutile type crystal, a mixed crystal system thereof, and an amorphous crystal.

As the alumina fine powder, alumina fine powder obtained by a Bayer process, a modified Bayer process, an ethylene chlorohydrin method, a spark discharged process, an organic aluminum hydrolysis method, thermal decomposition of aluminum alum, thermal decomposition of ammonium aluminum carbonate, and flame decomposition of aluminum chloride. As a crystal system, there may be used any of $\alpha$, $\beta$, $\gamma$, $\delta$, $\xi$, $\eta$, $\theta$,$\kappa$, $\chi$, and $\rho$ type crystals, a mixed crystal system thereof, and an amorphous crystal. Of those, $\alpha$, $\delta$, $\gamma$, and $\theta$ type crystals, a mixed crystal system, and an amorphous crystal are preferably used.

The surface of the fine powder is more preferably subjected to a hydrophobizing treatment with a coupling agent or silocone oil.

The hydrophobizing treatment for the surface of the fine powder includes a method of treating fine powder chemically or physically using an organosilicon compound or the like which reacts with or physically absorbs the fine powder.

The hydrophobizing treatment is preferably a method of treating silica fine powder produced by vapor phase oxidation of a silicon halide compound with an organosilicon compound. Examples of the organosilicon compound to be used in such method include the following: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, $\alpha$-chloroethyltrichlorosilane, $\beta$-chloroethyltrichlorosilane, chloromethyldimethylchlorosilane, a triorganosilylmercaptan, trimethylsilylmercaptan, a triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to one Si atom in a unit positioned at the end.

The above-mentioned flowability-imparting agent may be used alone or in combination of multiple kinds thereof. It is preferred that the flowability-imparting agent after the hydrophobizing treatment show a hydrophobicity measured by a methanol titration test in the range of 30 to 80.

The flowability-imparting agent having a specific surface area by nitrogen adsorption measured by a BET method of 30 $m^2/g$ or more, preferably 50 $m^2/g$ or more provides satisfactory results.

The flowability-imparting agent is used in an amount of preferably 0.1 to 8.0 parts by mass, more preferably 0.1 to 4.0 parts by mass with respect to 100 parts by mass of the toner particles (powder particles).

Inorganic fine powder other than those described above may be added to powder particles before heat treatment or powder particles after heat treatment in order to impart chargeability and flowability, for example. Examples of the inorganic fine powder include titanates and/or silicates of magnesium, zinc, cobalt, manganese, strontium, cerium, calcium, and barium.

It is preferred that the inorganic fine particles be used in an amount of preferably 0.1 to 10 parts by mass, more preferably 0.2 to 8 parts by mass with respect to 100 parts by mass of the toner particles (powder particles).

The toner may be mixed with a magnetic carrier so as to be used as a two-component developer.

As the magnetic carrier, for example, there may be used generally known carriers including iron powder whose surface is oxidized or unoxidized iron powder, particles of metals such as iron, lithium, calcium, magnesium, nickel, copper, zinc, cobalt, manganese, chromium, and rare earths, particles of alloys thereof, oxide particles, ferrite and other magnetic materials, and a magnetic material-dispersed resin carrier (so-called resin carrier) containing a magnetic material and a binder resin.

When the toner is mixed with the magnetic carrier so as to be used as a two-component developer, the mixing ratio of the carrier in this case is adjusted so that the concentration of the toner in the developer is preferably 2 mass % or more and 15 mass % or less, more preferably 4 mass % or more and 13 mass % or less.

In the present invention, before the heat treatment, an external additive such as a flowability-imparting agent, a transferring aid, and a charge stabilizer may be mixed with powder particles with a mixing machine such as a Henschel mixer.

It is preferred that the weight average diameter (D4) of toner particles obtained through heat treatment by the apparatus for heat treatment of the present invention be 4 μm or more and 12 μm or less.

The apparatus for heat treatment of the present invention can be applied to powder particles obtained by a known production method such as a pulverization method, a suspension polymerization method, an emulsion aggregation method, or a dissolution suspension method. Hereinafter, a procedure for producing toner by a pulverization method is described.

In a raw material mixing step, as raw materials for toner, at least a resin and a colorant are weighed in predetermined amounts and blended and mixed with each other. As a mixing apparatus, there are given, for example: a Henschel mixer (manufactured by MITSUI MINING. Co., Ltd.); a Super Mixer (manufactured by KAWATA MFG Co., Ltd.); a Ribocone (manufactured by OKAWARA CORPORATION); a Nauta Mixer, a Turburizer, and a Cyclomix (manufactured by Hosokawa Micron); a Spiral Pin Mixer (manufactured by Pacific Machinery & Engineering Co., Ltd.); and a Loedige Mixer (manufactured by MATSUBO Corporation).

Further, in a melt-kneading step, the mixed raw materials for toner are melt-kneaded to melt the resin and disperse the colorant or the like in the raw materials. As a kneading apparatus, there are given, for example: a TEM-type extruder (manufactured by TOSHIBA MACHINE Co., Ltd.); a TEX Biaxial Kneader (manufactured by The Japan Steel Works, Ltd.); a PCM Kneader (manufactured by Ikegai machinery Co.); and a Kneadex (manufactured by Mitsui Mining Co., Ltd.). A continuous kneader such as a mono-axial or biaxial extruder is more preferred than a batch type kneader because the continuous kneader has an advantage such as being applicable to continuous production.

Further, a colored resin composition obtained by melt-kneading the raw materials for toner is rolled with a twin roll or the like after the melt-kneading and cooled through a cooling step of cooling with water or the like.

The cooled product of the colored resin composition thus obtained is pulverized into particles each having a desired particle diameter in a pulverization step. In the pulverization step, first, the cooled product is roughly pulverized with a crusher, a hammer mill, a feather mill, or the like, and then finely pulverized with a criptron system (manufactured by Kawasaki Heavy Industries Inc.), a super rotor (manufactured by Nisshin Engineering Inc.), or the like to obtain toner fine particles.

The toner fine particles thus obtained are classified into surface-modified particles of toner each having a desired particle diameter in a classification step. As a classifier, there are given, for example, a Turboplex, a TSP separator, a TTSP separator (manufactured by Hosokawa Micron Ltd.), and an ELBO-JET (manufactured by Nittetsu Mining Co., Ltd.).

Then, in a heat treatment step, the obtained toner particles (powder particles) are spheroidized through use of the apparatus for heat treatment of the present invention to obtain surface-modified particles.

After the surface modification, a sieving machine such as: a Ultra Sonic (manufactured by Koei Sangyo Co., Ltd.); a Rezona Sieve or a Gyro Sifter (manufactured by Tokuju Corporation); a Turbo Screener (manufactured by Turbo Kogyo Co., Ltd.); or a HI-VOLTA (manufactured by TOYO HITEC Co., LTD.) may be used for sieving coarse particles and the like, if required.

It should be noted that the heat treatment step may be performed after the pulverization or after the classification.

<Methods of Measuring Weight Average Particle Diameter (D4) and Number Average Particle Diameter (D1)>

The weight average particle diameter (D4) and the number average particle diameter (D1) of the powder particles and the toner were measured with the number of effective measurement channels of 25,000 by using a precision particle size distribution measuring apparatus based on a pore electrical resistance method provided with a 100-μm aperture tube "Coulter Counter Multisizer 3" (trade name; manufactured by Beckman Coulter, Inc.) and dedicated software included thereto "Beckman Coulter Multisizer 3 Version 3.51" (manufactured by Beckman Coulter, Inc.) for setting measurement conditions and analyzing measurement data. Then, the measurement data was analyzed to calculate the diameters.

An electrolyte solution prepared by dissolving reagent grade sodium chloride in ion-exchanged water so as to have a concentration of about 1 mass %, for example, an "ISOTON II" (manufactured by Beckman Coulter, Inc.) can be used in the measurement.

It should be noted that the dedicated software is set as described below prior to the measurement and the analysis.

In the "change standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a threshold/noise level measurement button. In addition, a current is set to 1,600 μA, a gain is set to 2, and an electrolyte solution is set to an ISOTON II, and a check mark is placed in a check box as to whether the aperture tube is flushed after the measurement.

In the "setting for conversion from pulse to particle diameter" screen of the dedicated software, a bin interval is set to a logarithmic particle diameter, the number of particle diameter bins is set to 256, and a particle diameter range is set to the range of 2 μm to 60 μm.

A specific measurement method is as described below.

(1) About 200 ml of the electrolyte solution are charged into a 250-ml round-bottom beaker made of glass dedicated for the Multisizer 3. The beaker is set in a sample stand, and the electrolyte solution in the beaker is stirred with a stirrer rod at 24 rotations/sec in a counterclockwise direction. Then, dirt and bubbles in the aperture tube are removed by the "aperture flush" function of the dedicated software.

(2) About 30 ml of the electrolyte solution are charged into a 100-ml flat-bottom beaker made of glass. About 0.3 ml of a diluted solution prepared by diluting a "Contaminon N" (a 10-mass % aqueous solution of a neutral detergent for washing a precision measuring device formed of a nonionic surfactant, an anionic surfactant, and an organic builder and having a pH of 7 manufactured by Wako Pure Chemical Industries, Ltd.) with ion-exchanged water by three parts by mass fold is added as a dispersant to the electrolyte solution.

(3) An ultrasonic dispersing unit "Ultrasonic Dispension System Tetora 150" (manufactured by Nikkaki Bios Co., Ltd.) in which two oscillators each having an oscillatory frequency of 50 kHz are built so as to be out of phase by 180° and which has an electrical output of 120 W is prepared. A predetermined amount of ion-exchanged water is charged into the water tank of the ultrasonic dispersing unit. About 2 ml of the Contaminon N are charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte solution in the beaker may resonate with an ultrasonic wave from the ultrasonic dispersing unit to the fullest extent possible.

(5) About 10 mg of toner are gradually added to and dispersed in the electrolyte solution in the beaker in the section (4) in a state in which the electrolyte solution is irradiated with the ultrasonic wave. Then, the ultrasonic dispersion treatment is continued for an additional 60 seconds. It should be noted that the temperature of water in the water tank is appropriately adjusted so as to be 10° C. or more and 40° C. or less upon ultrasonic dispersion.

(6) The electrolyte solution in the section (5) in which the toner has been dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The measurement data is analyzed with the dedicated software included with the apparatus, and the weight average particle diameter (D4) and the number average particle diameter (D1) are calculated. It should be noted that an "average diameter" on the "analysis/volume statistics (arithmetic average)" screen of the dedicated software when the dedicated software is set to show a graph in a vol % unit is the weight average particle diameter (D4), and an "average diameter" on the "analysis/number statistics (arithmetic average)" screen of the dedicated software when the dedicated software is set to show a graph in a number % unit is the number average particle diameter (D1).

<Method of Calculating Fine Powder Amount>

A fine powder amount (number %) on a number basis in the powder particles or the toner is calculated as described below.

For example, the number % of particles each having a particle diameter of 4.0 μm or less in the toner is calculated by the following procedure. After the measurement with the Multisizer 3, (1) the chart for the results of the measurement is displayed in terms of number % by setting the dedicated software to "graph/number %," and (2) A check mark is placed in "<" of the particle diameter-setting portion in the "format/particle diameter/particle diameter statistics" screen, and "4" is input in the particle diameter-inputting portion below the particle diameter-setting portion. Then, (3) the numerical value in the "<4 μm" display portion when the "analysis/number statistic (arithmetic average)" screen is displayed is the number % of the particles each having a particle diameter of 4.0 μm or less in the toner.

<Method of Calculating Coarse Powder Amount>

A coarse powder amount (vol %) on a volume basis in the powder particles or the toner is calculated by the following procedure.

For example, the vol % of particles each having a particle diameter of 10.0 μm or more in the toner is calculated by the following procedure. After the measurement with the Multisizer 3, (1) the chart for the results of the measurement is displayed in terms of vol % by setting the dedicated software to "graph/vol %," and (2) a check mark is placed in ">" of the particle diameter-setting portion in the "format/particle diameter/particle diameter statistics" screen, and "10" is input in the particle diameter-inputting portion below the particle diameter-setting portion. Then, (3) the numerical value in the ">10 μm" display portion when the "analysis/volume statistic (arithmetic average)" screen is displayed is the vol % of the particles each having a particle diameter of 10.0 μm or more in the toner.

<Measurement of Average Circularity>

The average circularity of the powder particles or the toner is measured under measurement and analysis conditions at the time of correction operation with a flow-type particle image analyzer "FPIA-3000" (manufactured by SYSMEX CORPORATION).

A specific measurement method is as described below. First, to 20 ml of ion-exchanged water are added a suitable amount of a surfactant as a dispersant, preferably an alkylbenzene sulfonate, and then 0.02 g of a measurement sample. The mixture is subjected to a dispersion treatment for 2 minutes using a desktop ultrasonic cleaning and dispersing unit having an oscillatory frequency of 50 kHz and an electrical output of 150 W (for example, a "VS-150" (manufactured by VELVO-CLEAR, for example)) so that a dispersion liquid for measurement may be obtained. At that time, the dispersion liquid is appropriately cooled so as to have a temperature of 10° C. or more and 40° C. or less.

The flow-type particle image analyzer mounted with a regular objective lens (magnification: 10) is used in the measurement, and a particle sheath "PSE-900A" (manufactured by SYSMEX CORPORATION) is used as a sheath liquid. The dispersion liquid prepared in accordance with the procedure is introduced into the flow-type particle image analyzer, and 3,000 toner particles are subjected to measurement according to the total count mode of an HPF measurement mode. Then, the average circularity of the powder particles or the toner is determined with a binarization threshold at the time of particle analysis set to 85% and particle diameters to be analyzed limited to ones each corresponding to a circle-equivalent diameter of 2.00 pm or more and 200.00 μm or less.

On the measurement, automatic focusing is performed with standard latex particles (obtained by diluting, for example, 5200A manufactured by Duke Scientific with ion-exchanged water) prior to the initiation of the measurement. After that, focusing is preferably performed every two hours from the initiation of the measurement.

It should be noted that in each example of the present application, a flow-type particle image analyzer which had been subjected to a calibration operation by SYSMEX CORPORATION and received a calibration certificate issued by SYSMEX CORPORATION was used. The measurement was performed under measurement and analysis conditions identical to those at the time of the reception of the calibration certificate except that particle diameters to be analyzed were limited to ones each corresponding to a circle-equivalent diameter of 2.00 μm or more and 200.00 μm or less.

<Method of Calculating Proportion of Particles Each having Circularity of 0.990 or More>

The proportion of particles each having a circularity of 0.990 or more in the powder particles or the toner is represented by a frequency (%). Specifically, in the circularity of the powder particles or the toner measured by an FPIA-3000, a value obtained by adding a value of a frequency (%) in the range of 1.00 in a frequency table to a value of a frequency (%) of 0.990->1.000 is used.

EXAMPLES (Polyester Resin 1)

The following materials were weighed and added to a reaction vessel equipped with a cooling tube, a stirrer, and a nitrogen introduction tube.

| | |
|---|---|
| Terephthalic acid | 17.6 parts by mass |
| Polyoxyethylene(2.2)-2, 2-bis(4-hydroxyphenyl)propane | 76.2 parts by mass |
| Titanium dihydroxybis(triethanolaminate) | 0.2 part by mass |

Then, the materials were heated to 220° C. and allowed to react for 8 hours while nitrogen was being introduced to the reaction vessel and generated water was being removed. Then, 1.5 parts by mass of trimellitic anhydride were added to the mixture. The resultant mixture was heated to 180° C. and allowed to react for 4 hours to synthesize a polyester resin 1.

The molecular weight of the polyester resin 1 determined by GPC was as follows: a weight average molecular weight (Mw) of 82,400; a number average molecular weight (Mn) of 3,300; and a peak molecular weight (Mp) of 8,450. The glass transition temperature (Tg) of the polyester resin 1 was 63° C. and the softening point (½ method) thereof was 110° C.

(Production of Toner Particles A)

Polyester resin 1: 100 parts by mass

Paraffin wax: 6 parts by mass (Peak temperature of maximum endothermic peak): 78° C.) Aluminum 3,5-di-t-butylsalicylate compound: 1.0 part by mass C.I. Pigment Blue 15:3: 5 parts by mass The above-mentioned materials were mixed well with a Henschel mixer (FM-75 type manufactured by Nippon Coke & Engineering Co., Ltd.) and then kneaded with a biaxial kneader (PCM-30 type manufactured by Ikegai Corp.). The obtained kneaded product was cooled and roughly pulverized with a hammer mill and then finely pulverized with a mechanical pulverizer (T-250: manufactured by Freund-Turbo Corporation) to obtain finely pulverized toner B-1.

The obtained finely pulverized toner B-1 was subjected to classification for cutting off fine powder and coarse powder with a rotary classifier (TTSP100 manufactured by Hosokawa Micron Ltd.) to obtain toner particles a each having a weight average particle diameter of 6.5 μm, having an abundance ratio of particles each having a particle diameter of 4.0 μm or less of 25.6 number %, and containing 3.0 vol % of particles each having a particle diameter of 10.0 μm or more.

The toner particles a were measured for a circularity with an FPIA-3000. As a result, the average circularity was 0.950 and the frequency of particles each having a circularity of 0.990 or more was 1.5%.

Further, the following materials were placed in a Henschel mixer (FM-75 type manufactured by Nippon Coke & Engineering Co., Ltd.) and mixed for 3 minutes with a circumferential velocity of rotary blades set to 35.0 m/sec, and thus, base particles in which silica and titanium oxide adhere to the surface of the toner particles a were obtained.

Toner particles a: 100 parts by mass

Silica: 3.5 parts by mass (obtained by subjecting silica fine particles produced by a sol-gel method to a surface treatment with 1.5 mass % of hexamethyldisilazane, followed by adjusting them to a desired particle size distribution by classification)

Titanium oxide: 0.5 part by mass (obtained by subjecting metatitanic acid having anatase-type crystallinity to a surface treatment)

It is known that the flowability of the toner particles themselves and the efficiency of the heat treatment are enhanced by allowing silica and titanium oxide to adhere to the toner particles a. As a result, a treatment temperature, a hot air amount, and an injection air amount can be expected to be reduced, and the generation of coarse particles can also be suppressed.

Hereinafter, the base particles are defined as toner particles A. The particle size and circularity of the toner particles A are the same as those of the toner particles a.

Example 1

In this example, the toner particles a and the toner particles A were heat-treated through use of the apparatus for heat treatment illustrated in FIG. 1.

It should be noted that the inner diameter (diameter) of the main body of the apparatus for heat treatment is 450 mm, the outer diameter (diameter) of the center pole is 330 mm, and the height from a top board of the apparatus to a bottom board thereof is 1,350 mm. The outlet portion (2A) for the raw materials is divided into eight.

Figure 9:
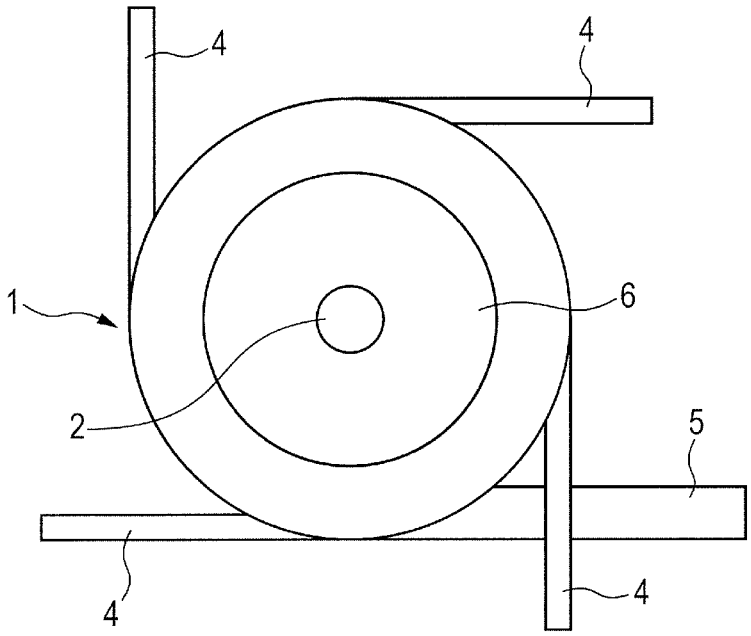
FIG. 9 is a cross-sectional view taken along the line 9-9 in FIG. 1.

First, the supply amount of the toner particles a was set to 40 kg/hr, and the operation conditions of the apparatus were adjusted so that the average circularity of the particles after a heat treatment became 0.970. The operation conditions at this time were as follows. The hot air temperature was set to 165° C. and the hot air flow rate was set to 25.5 $m^3$/min. Further, the cold air temperature was set to −5° C. and the injection air flow rate was set to 3.0 $m^3$/min. The total air amount in the first stage of the cold air supply unit was 6.0 $m^3$/min, and the total air amount was divided into four (see FIG. 9) so that each air amount became 1.5 $m^3$/min. The total air amount in the second stage of the cold air supply unit was 2.0 $m^3$/min, and the total air amount was divided into four so that each air amount became 0.5 $m^3$/min.

The surface-modified particles obtained at this time each had a weight average diameter (D4) of 6.9 μm, an abundance ratio of particles each having a particle diameter of 4.0 μm or less of 23.4 number %, and an abundance ratio of particles each having a particle diameter of 10.0 μm or more of 9.1 vol %.

Further, the surface-modified particles were measured for a circularity with an FPIA-3000. As a result, the average circularity was 0.970 and the frequency of particles each having a circularity of 0.990 or more was 25.8%.

Next, the toner particles A were used, the supply amount thereof was set to 40 kg/hr, and the operation conditions of the apparatus were adjusted so that the average circularity of the particles after the heat treatment became 0.970. The operation conditions at this time were as follows. The heat treatment was carried out at a hot air temperature of 150° C. and a hot air flow rate of 25.0 $m^3$/min. Further, the cold air temperature was set to −5° C. and the injection air flow rate was set to 2.5 $m^3$/min. The total air amount in the first stage of the cold air supply unit was 6.0 $m^3$/min, and the total air amount was divided into four (see FIG. 9) so that each air amount became 1.5 $m^3$/min. The total air amount in the second stage of the cold air supply unit was 2.0 $m^3$/min, and the total air amount was divided into four so that each air amount became 0.5 $m^3$/min. The surface-modified particles obtained at this time each had a weight average diameter (D4) of 6.6 μm, an abundance ratio of particles each having a particle diameter of 4.0 μm or less of 23.6 number %, and an abundance ratio of particles each having a particle diameter of 10.0 μm or more of 4.5 vol %.

Further, the surface-modified particles were measured for a circularity with an FPIA3000. As a result, the average circularity was 0.970 and the frequency of particles each having a circularity of 0.990 or more was 23.8%.

Next, the supply amount of the toner particles A was set to 80 kg/hr, and the operation conditions of the apparatus were adjusted in order to obtain surface-modified particles each having an average circularity of 0.970. The operation conditions at this time were as follows. The heat treatment was carried out at a hot air temperature of 160° C. and a hot air flow rate of 26.0 $m^3$/min. The cold air temperature was set to −5° C. and the injection air flow rate was set to 3.5

$m^3$/min. For the cold air flow rate, the total air amount supplied in the first stage was 6.0 $m^3$/min, and the total air amount was divided into four (see (4) in FIG. 9) so that each air amount became 1.5 $m^3$/min. The total air amount supplied in the second stage was 2.0 $m^3$/min, and the total air amount was divided into four so that each air amount became 0.5 $m^3$/min.

The surface-modified particles obtained at this time each had a weight average diameter (D4) of 6.7 μm, an abundance ratio of particles each having a particle diameter of 4.0 μm or less of 23.1 number %, and an abundance ratio of particles each having a particle diameter of 10.0 μm or more of 6.2 vol %. Further, the surface-modified particles were measured for a circularity with an FPIA-3000. As a result, the average circularity was 0.970 and the frequency of particles each having a circularity of 0.990 or more was 24.1%.

Further, in the heat treatment of each of the toner particles a and the toner particles A, the supply of the toner particles was stopped after one-hour operation, and the fusion state in the apparatus was checked. As a result, no fused product was observed.

Example 1 was evaluated based on the following evaluation criteria.

<Evaluation of Frequency of Particles Each having Circularity of 0.990 or More>

A frequency b (%) of particles each having a circularity of 0.990 or more in the obtained surface-modified particles was evaluated based on the following criteria.

A: 25.0<b

B: 25.0≤b<30.0

C: 30.0≤b<35.0

D: 35.0≤b<40.0

E: b≤40.0

<Evaluation of Coarse Powder Amount>

Further, regarding the surface-modified particles obtained at this time, an increase ratio s (vol %) of particles each having a particle diameter of 10.0 μm or more in the surface-modified particles was determined based on the following criteria.

s=Ratio (vol %) of particles each having a particle diameter of 10.0 μm or more after heat treatment—ratio (vol %) of particles each having a particle diameter of 10.0 μm or more before heat treatment A: 5.0<s B: 5.0≤s<10.0

C: 10.0≤s<15.0

D: 15.0≤s<20.0

E: s≤20.0

<Evaluation of Fusion>

After one-hour operation, the supply of the base particles was stopped, and a scope portion of an industrial videoscope "IPLEX SA II R" (manufactured by Olympus Corporation) was inserted through a check port (not shown) on a side surface of the apparatus for heat treatment to check a fusion state in the apparatus. The fusion state was determined based on the following criteria.

A: No fused product is observed.

B: Although a fused product is slightly observed, the fused product can be ignored in terms of operation.

C: Although fusion is observed, the fusion can be ignored in terms of operation.

D: Fusion is observed, and the operation needs to be stopped.

E: A large fused product is observed, and the operation needs to be stopped.

The operation conditions and the results of Example 1 are summarized in Tables 1 and 2, respectively.

Example 2

Figure 2:
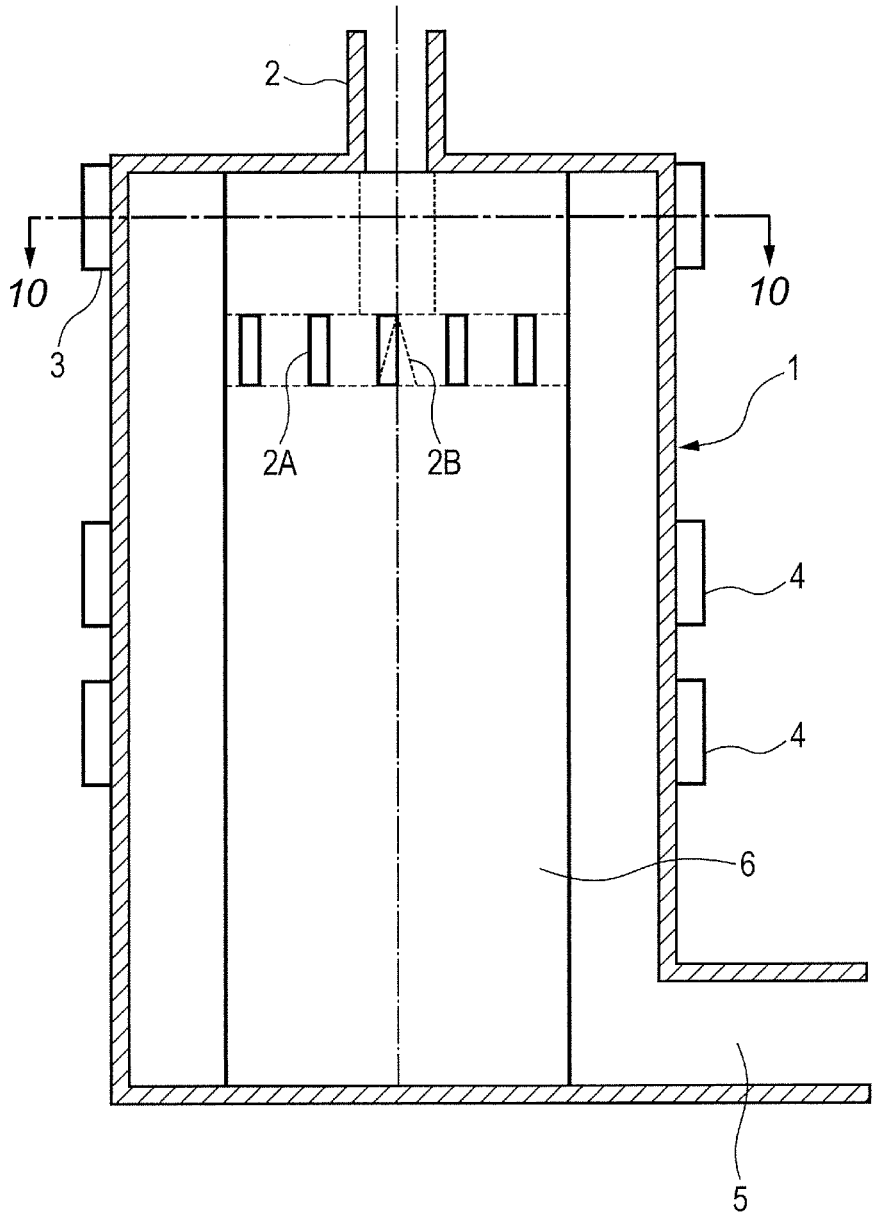
FIG. 2 is a cross-sectional view illustrating a structure of Example 2.

In this example, the apparatus for heat treatment illustrated in FIG. 2 was used.

Figure 10:
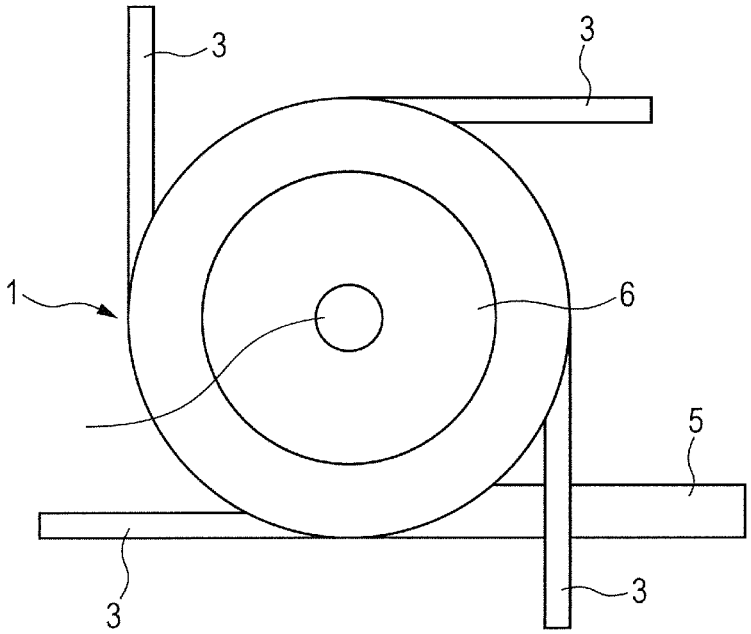
FIG. 10 is a cross-sectional view taken along the line 10-10 in FIG. 2.

In the structure of FIG. 2, multiple hot air supply units were provided, and hot air was introduced in four divided portions from a tangent direction of a horizontal surface in an upper part of the apparatus (see FIG. 10). The outlet portion (2A) for the raw materials was divided into eight.

In the above-mentioned structure, the toner particles A were heat-treated under the operation conditions shown in Table 1.

The results are summarized in Table 2.

Example 3

Figure 3:
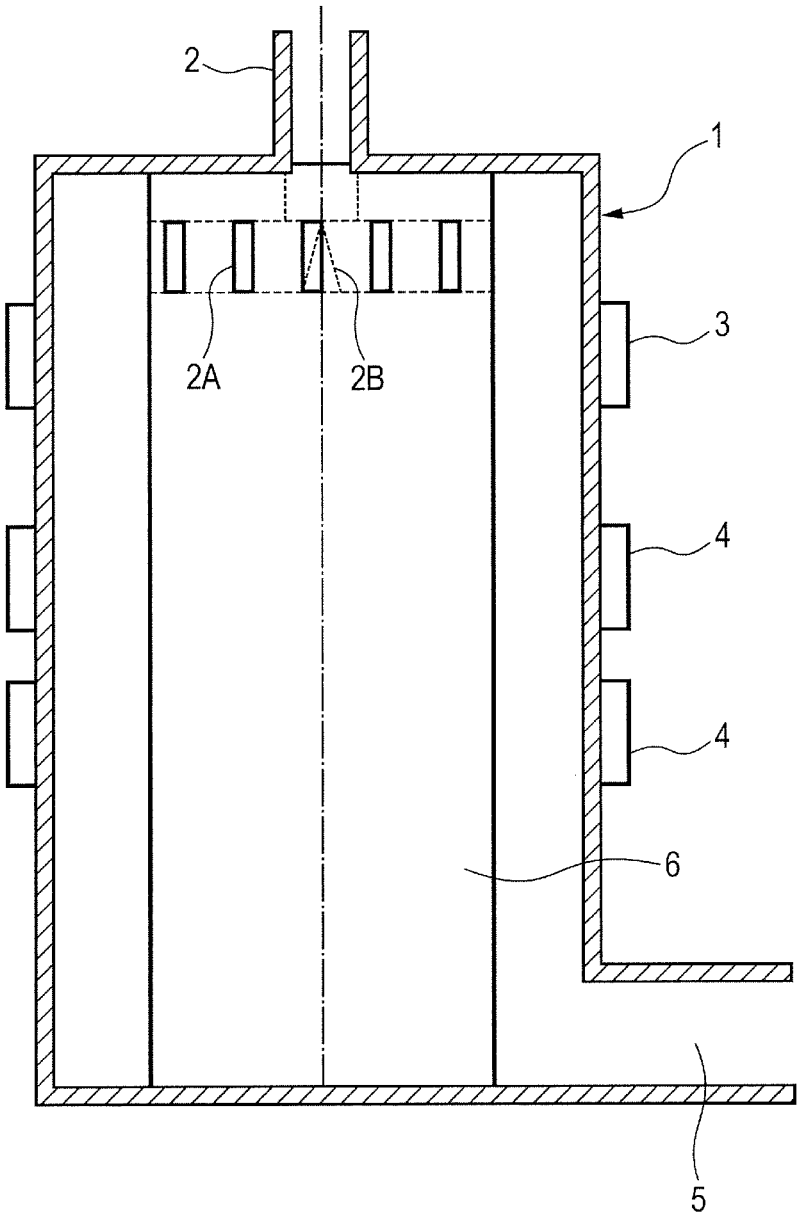
FIG. 3 is a cross-sectional view illustrating a structure of Example 3.

In this example, the apparatus for heat treatment illustrated in FIG. 3 was used.

In the structure of FIG. 3, the hot air supply unit was provided slightly below the lower end of the raw material outlet portion (in this case, 10 mm below the raw material outlet portion), and hot air was introduced from a tangent direction of a horizontal surface of the apparatus in four divided portions. The raw material outlet portion (2A) was divided into eight.

In the above-mentioned structure, the toner particles A were heat-treated under the operation conditions shown in Table 1.

The results are summarized in Table 2.

Example 4

Figure 4A:
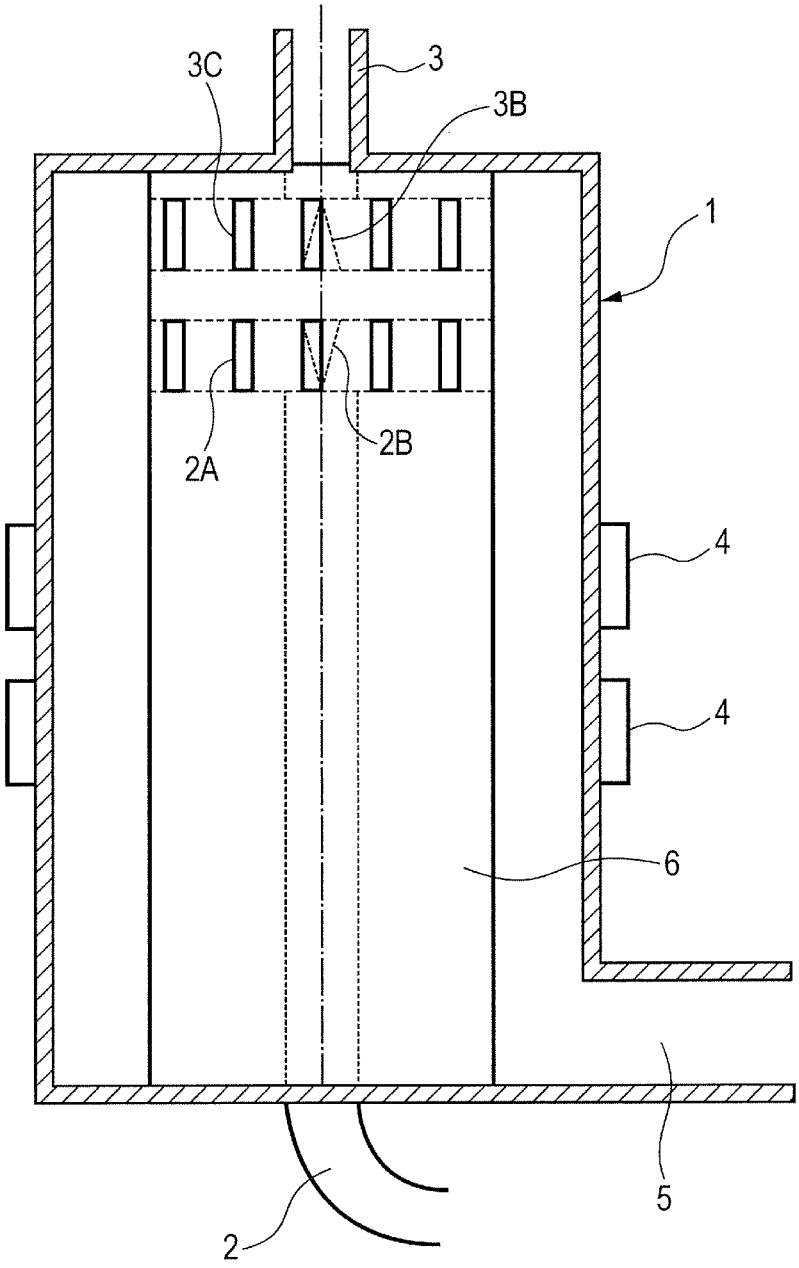
FIG. 4A is a cross-sectional view illustrating a structure of Example 4.

In this example, the apparatus for heat treatment illustrated in FIG. 4A was used to heat-treat the toner particles A.

In the structure of FIG. 4A, a hot air outlet portion (3C) was provided at the center pole (6), and hot air was introduced in eight divided portions. The raw material outlet portion (2A) was divided into eight.

In the above-mentioned structure, the toner particles A were heat-treated under the operation conditions shown in Table 1.

The results are summarized in Table 2.

Example 5

Figure 4B:
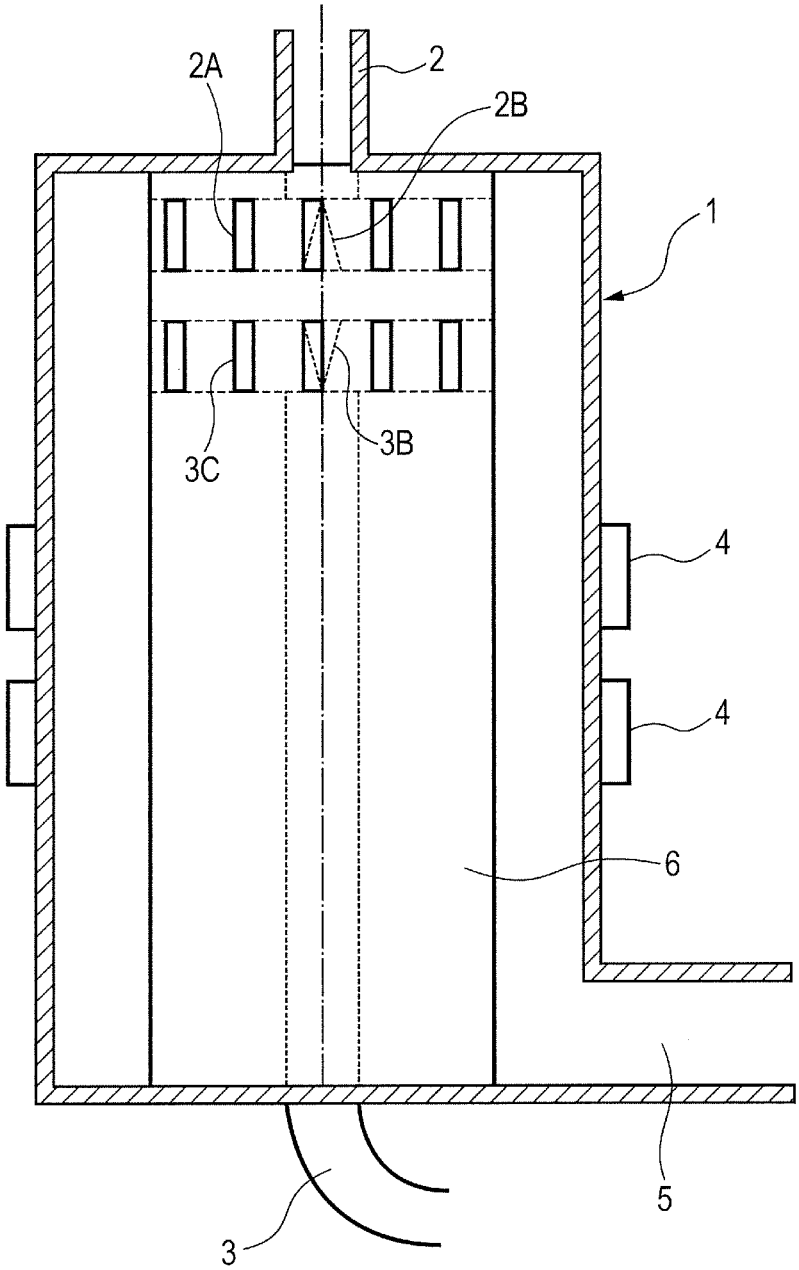
FIG. 4B is a cross-sectional view illustrating a structure of Example 5.

In this example, as illustrated in FIG. 4B, the toner particles A were heat-treated through use of an apparatus having such a structure that the positions of the hot air supply unit and that of the powder particle supply unit were switched in FIG. 4A.

In the structure of this example, hot air was introduced from a bottom part of the apparatus to the center pole in eight divided portions. The raw material outlet portion (2A) was divided into eight.

In the above-mentioned structure, the toner particles A were heat-treated under the operation conditions shown in Table 1.

The results are summarized in Table 2.

Comparative Example 1

In Comparative Example 3, the apparatus for heat treatment illustrated in FIG. 6 was used to heat-treat the toner particles A.

In the apparatus for heat treatment of FIG. 6, the toner particles are supplied to the apparatus through multiple nozzles provided at the powder particle supply unit (2), and the nozzles are placed radially toward the hot air supply unit (3) provided on an outer side of the powder particle supply unit (2).

In the above-mentioned apparatus, a heat treatment was conducted so that the average circularity of particles after the heat treatment became 0.970 at a supply amount of 40 kg/hr. The operation conditions at this time were as follows: a hot air temperature of 265° C.; a hot air amount of 25.0 $m^3$/min; and an injection air flow rate of 2.5 $m^3$/min. It should be noted that, in the apparatus, cooling is conducted by introducing outside air from the outside of the hot air supply unit. The surface-modified particles obtained at this time each had a weight average diameter (D4) of 7.8 μm, an abundance ratio of particles each having a particle diameter of 4.0 μm or less of 21.7 number %, and an abundance ratio of particles each having a particle diameter of 10.0 μm or more of 19.8 vol %. The particles were measured for a circularity with an FPIA-3000. As a result, the average circularity was 0.970 and the frequency of particles each having a circularity of 0.990 or more was 41.8%.

Next, the supply amount of the toner particles A was set to 80 kg/hr and the treatment was conducted with adjustment of the operation conditions so that the average circularity of the particles after the heat treatment became 0.970. The operation conditions at this time were as follows: a hot air temperature of 290° C.; a hot air amount of 26.0 $m^3$/min; and an injection air flow rate of 3.5 $m^3$/min. The surface-modified particles obtained at this time each had a weight average diameter (D4) of 8.0 μm, an abundance ratio of particles each having a particle diameter of 4.0 μm or less of 20.6 number %, and an abundance ratio of particles each having a particle diameter of 10.0 μm or more of 25.6 vol %. The particles were measured for a circularity with an FPIA-3000. As a result, the average circularity was 0.970 and the frequency of particles each having a circularity of 0.990 or more was 40.9%.

Further, after one-hour operation, the supply of the toner particles A was stopped and the fusion state in the apparatus was checked. The fusion was observed on an inner side of the outlet portion of the hot air supply unit.

The results are summarized in Table 2.

In Comparative Example 1, the proportion of the toner particles each having a particle diameter of 10.0 μm or more increased and the frequency of particles each having a circularity of 0.990 or more increased. The reasons for this are as follows. With this structure, powder particles are not dispersed sufficiently, and it is impossible to apply an amount of heat in accordance with the particle diameter of the toner particles unlike the apparatus for heat treatment of the present invention. Further, there is a variation in the amount of heat to be applied to toner particles irrespective of the particle diameter of the toner particles, and the mixing ratio of the toner particles not heat-treated sufficiently increases. When the amount of heat is increased so as to decrease the mixing ratio of untreated toner particles, although the average circularity increases, the proportion of toner particles each having a circularity of 0.990 or more increases and the toner particles coalesce with each other.

Comparative Example 2

In this comparative example, the toner particles A were heat-treated through use of the apparatus for heat treatment illustrated in FIG. 7.

The powder particle supply unit (2) is configured in a trumpet shape so that toner particles are supplied to the apparatus while being rotated on an inner surface. The hot air supply unit (3) is provided on an outer circumference of the powder particle supply unit (2), and the supply direction of hot air is directed to the toner particles supplied from the powder particle supply unit (2). Further, a cold air supply unit is provided in an outer circumferential portion and on the downstream side of the apparatus.

In the above-mentioned apparatus, the toner particles A were heat-treated with adjustment of the operation conditions so that the average circularity of particles after the heat treatment became 0.970 at a supply amount of 40 kg/hr.

The operation conditions at this time were as follows: a hot air temperature of 285° C.; a hot air amount of 25.0 $m^3$/min; an injection air flow rate of 2.5 $m^3$/min; a cold air flow rate of 10 $m^3$/min; and a cold air temperature of −5° C. The surface-modified particles obtained at this time each had a weight average diameter (D4) of 7.6 μm, an abundance ratio of particles each having a particle diameter of 4.0 μm or less of 22.1 number %, and an abundance ratio of particles each having a particle diameter of 10.0 μm or more of 17.0 vol %.

Further, the surface-modified particles were measured for a circularity with an FPIA-3000. As a result, the average circularity was 0.970 and the frequency of particles each having a circularity of 0.990 or more was 35.9%.

Next, the supply amount of the toner particles A was set to 80 kg/hr and the treatment was conducted with adjustment of the operation conditions so that the average circularity became 0.970. The operation conditions at this time were as follows: a hot air temperature of 315° C.; a hot air amount of 26.0 $m^3$/min; an injection air flow rate of 3.5 $m^3$/min; a cold air flow rate of 10 $m^3$/min; and a cold air temperature of −5° C. The surface-modified particles obtained at this time each had a weight average diameter (D4) of 7.8 μm, an abundance ratio of particles each having a particle diameter of 4.0 μm or less of 21.5 number %, and an abundance ratio of particles each having a particle diameter of 10.0 μm or more of 20.1 vol %. The surface-modified particles were measured for a circularity with an FPIA-3000. As a result, the average circularity was 0.970 and the frequency of particles each having a circularity of 0.990 or more was 36.7%.

Further, after one-hour operation, the supply of the toner particles A was stopped and the fusion state in the apparatus was checked. The fusion was observed in an inner side of the outlet portion of the hot air supply unit and an outer circumferential portion of the outlet portion of the powder particle supply unit.

The results are summarized in Table 2.

In Comparative Example 2, the proportion of toner particles each having a particle diameter of 10.0 μm or more increased and the frequency of particles each having a circularity of 0.990 or more increased. The reasons for this are as follows. Although the powder particles are jetted while being rotated, the suction in a lower portion of the apparatus is at the center of the apparatus, and hence, the expected spread and rotation of the powder particles do not occur. This causes the powder particles to be dispersed insufficiently, and the powder particles do not sufficiently spread to hot air supplied from the hot air supply unit provided outside of the raw material supply unit, resulting in an uneven heat treatment. Therefore, the coalescence of the particles increases, which also increases the proportion of particles each having a circularity of 0.990 or more.

TABLE 1

| | | Raw material | Treatment amount (kg/hr) | Hot air temperature (° C.) | Hot air amount ($m^3$/min) | Cold air amount First stage ($m^3$/min) | Cold air amount Second stage ($m^3$/min) | Cold air temperature (° C.) | Injection air flow rate ($m^3$/min) |
|---|---|---|---|---|---|---|---|---|---|
| Example 1 | 1 | Toner particles a | 40 | 165 | 25.5 | 6.0 | 2.0 | −5 | 3.0 |
| | 2 | Toner particles A | 40 | 150 | 25.0 | 6.0 | 2.0 | −5 | 2.5 |
| | 3 | Toner particles A | 80 | 160 | 26.0 | 6.0 | 2.0 | −5 | 3.5 |
| Example 2 | 1 | Toner particles A | 40 | 160 | 25.0 | 6.0 | 2.0 | −5 | 2.5 |
| | 2 | Toner particles A | 80 | 170 | 26.0 | 6.0 | 2.0 | −5 | 3.5 |
| Example 3 | 1 | Toner particles A | 40 | 155 | 25.0 | 6.0 | 2.0 | −5 | 2.5 |
| | 2 | Toner particles A | 80 | 165 | 26.0 | 6.0 | 2.0 | −5 | 3.5 |
| Example 4 | 1 | Toner particles A | 40 | 150 | 25.0 | 6.0 | 2.0 | −5 | 2.5 |
| | 2 | Toner particles A | 80 | 160 | 26.0 | 6.0 | 2.0 | −5 | 3.5 |
| Example 5 | 1 | Toner particles A | 40 | 155 | 25.0 | 6.0 | 2.0 | −5 | 2.5 |
| | 2 | Toner particles A | 80 | 165 | 26.0 | 6.0 | 2.0 | −5 | 3.5 |
| Comparative | 1 | Toner particles A | 40 | 265 | 25.0 | - (outside air) | | 18 | 2.5 |
| Example 1 | 2 | Toner particles A | 80 | 290 | 26.0 | - (outside air) | | 18 | 3.5 |
| Comparative | 1 | Toner particles A | 40 | 285 | 25.0 | 10.0 | | −5 | 2.5 |
| Example 2 | 2 | Toner particles A | 80 | 315 | 26.0 | 10.0 | | −5 | 3.5 |

TABLE 2

| | | Apparatus for heat treatment | Weight average diameter (D4) (μm) | Proportion of particles each having particle diameter of 4.0 μm or less (number %) | Proportion of particles each having particle diameter of 10.0 μm or more (vol %) | Average circularity | Frequency of particles each having circularity of 0.990 or more (frequency %) | Evalution | s (number %) | Evaluation | Evaluation of fusion |
|---|---|---|---|---|---|---|---|---|---|---|---|
| Toner particles a | | — | 6.5 | 25.6 | 3.0 | 0.950 | 1.5 | — | — | — | — |
| Toner particles A | | — | 6.5 | 25.6 | 3.0 | 0.950 | 1.5 | — | — | — | — |
| Example 1 | 1 | FIG. 1 | 6.9 | 23.4 | 9.1 | 0.970 | 25.8 | B | 6.1 | B | A |
| | 2 | | 6.6 | 23.6 | 4.5 | 0.970 | 23.8 | A | 1.5 | A | A |
| | 3 | | 6.7 | 23.1 | 6.2 | 0.970 | 24.1 | A | 3.2 | A | A |
| Example 2 | 1 | FIG. 2 | 6.7 | 23.3 | 5.9 | 0.970 | 23.9 | A | 2.9 | A | A |
| | 2 | | 6.8 | 23.2 | 7.6 | 0.970 | 24.0 | A | 4.6 | A | A |
| Example 3 | 1 | FIG. 3 | 6.6 | 23.6 | 4.8 | 0.970 | 24.3 | A | 1.8 | A | A |
| | 2 | | 6.7 | 23.5 | 6.5 | 0.970 | 24.1 | A | 3.5 | A | B |
| Example 4 | 1 | FIG. 4A | 6.6 | 23.4 | 4.7 | 0.970 | 23.9 | A | 1.7 | A | A |
| | 2 | | 6.7 | 23.7 | 6.3 | 0.970 | 23.6 | A | 3.3 | A | A |
| Example 5 | 1 | FIG. 4B | 6.6 | 23.8 | 4.9 | 0.970 | 23.8 | A | 1.9 | A | A |
| | 2 | | 6.7 | 23.1 | 6.6 | 0.970 | 24.0 | A | 3.6 | A | B |
| Comparative | 1 | FIG. 6 | 7.8 | 21.7 | 19.8 | 0.970 | 41.8 | E | 16.8 | D | C |
| Example 1 | 2 | | 8.0 | 20.6 | 25.6 | 0.970 | 40.9 | E | 22.6 | E | D |
| Comparative | 1 | FIG. 7 | 7.6 | 22.1 | 17.0 | 0.970 | 35.9 | D | 14.0 | C | C |
| Example 2 | 2 | | 7.8 | 21.5 | 20.1 | 0.970 | 36.7 | D | 17.1 | D | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-130923 Jun. 13, 2011, which is hereby incorporated by reference herein in its entirety.

REFERENCE SIGNS LIST

1 apparatus main body
2 powder particle supply unit
2A raw material outlet portion
2B conical member
3 hot air supply unit
3A regulating member
3B conical member
3C hot air outlet portion
4 cold air supply unit
5 collection unit
6 center pole

The invention claimed is:

1. An apparatus for heat-treating powder particles each of which contains a binder resin and a colorant, the apparatus comprising:

(1) a treatment chamber having a cylindrical shape, in which the powder particles are heat-treated;

(2) a columnar member having a substantially circular shape in cross-section, the columnar member being provided on a center axis of the treatment chamber so as to protrude from a lower end part of the treatment chamber toward an upper end part of the treatment chamber;

(3) a powder particle supply unit which comprises multiple particle supply ports provided on an outer circumferential surface of the columnar member, for ejecting and supplying the powder particles to the treatment chamber;

(4) a hot air supply unit for supplying hot air for heat-treating the supplied powder particles; and (5) a collection unit for collecting the heat-treated powder particles discharged outside the treatment chamber through a toner discharge port provided on the lower end part side of the treatment chamber, wherein the hot air supply unit is provided so that the hot air is supplied while being rotated along an inner circumferential surface of the treatment chamber, and the toner discharge port is provided in an outer circumferential portion of the treatment chamber so as to keep a rotation direction of the powder particles.

2. The apparatus for heat-treatment powder particles according to claim 1, further comprising a cold air supply unit provided on an upstream side relative to the toner discharge port.

3. The apparatus for heat-treating powder particles according to claim 2, wherein the cold air supply unit is provided so that a direction of supplying cold air is in the same direction as the rotation direction of the powder particles.

4. The apparatus for heat-treating powder particles according to claim 1, wherein the powder particle supply unit is provided so that a direction of the powder particles ejected from the multiple particle supply ports is the same as a rotation direction of the hot air supplied from the hot air supply unit, and the powder particle supply unit is directed to a downstream side of the hot air.

5. The apparatus for heat-treating powder particles according to claim 1, wherein the hot air supply unit is provided so that the hot air is supplied in a tangent direction of a horizontal surface of the apparatus for heat treatment from the outer circumferential portion of the treatment chamber, and the hot air supply unit comprises multiple hot air supply units.

6. A method of producing toner, comprising heat-treating powder particles containing a binder resin and a colorant through use of an apparatus for heat treatment, to thereby obtain the toner, wherein the apparatus for heat treatment comprises the apparatus for heat-treating powder particles according to claim 1.

* * * * *